US006078296A

United States Patent [19]

Wetter, Jr.

[11] Patent Number: 6,078,296

[45] Date of Patent: Jun. 20, 2000

[54] SELF-ACTUATED OFF-CENTER SUBREFLECTOR SCANNER

[75] Inventor: Pierce T. Wetter, Jr., Simi Valley, Calif.

[73] Assignee: Datron/Transco Inc., Simi Valley, Calif.

[21] Appl. No.: 09/203,276

[22] Filed: Dec. 1, 1998

[51] Int. Cl.[7] ..... H01Q 3/00

[52] U.S. Cl. ..... 343/766; 343/757; 343/781 CA

[58] Field of Search ..... 343/839, 766, 343/757, 781 CA, 755, 840; H01Q 3/00

[56] References Cited

U.S. PATENT DOCUMENTS

| | | | |
|---|---|---|---|
| 4,939,526 | 7/1990 | Tsuda | 343/781 CA |
| 5,198,827 | 3/1993 | Seaton | 343/781 CA |
| 5,351,060 | 9/1994 | Bayne | 343/781 CA |

*Primary Examiner*—Hoanganh Le
*Attorney, Agent, or Firm*—Edward A. Sokolski

[57] ABSTRACT

An optical reflector antenna utilizes a subreflector that is offset from the optical axis of the antenna and that revolves about the optical axis to scan the beam from the antenna in a circular path about the axis of the antenna to facilitate the search for and acquisition of a satellite for subsequent tracking and communications. The subreflector is mounted on a rotatable shaft that is aligned with the optical axis of the antenna. When the shaft is not being rotated, one or more springs hold the subreflector in a fixed position aligned with the optical axis of the antenna to facilitate tracking and communications. When the shaft is rotated, rotational forces cause the subreflector to shift to and remain at a position that is offset from the optical axis and the rotation of the shaft causes the offset subreflector to revolve about the optical axis of the antenna, thus scanning the beam from the antenna to facilitate the search for and and the acquisition of the satellite.

6 Claims, 2 Drawing Sheets

SELF-ACTUATED OFF-CENTER SUBREFLECTOR SCANNER

1. BACKGROUND OF THE INVENTION a. Field of the Invention

This invention pertains to optical, reflector antennas. More particularly this invention pertains to the scanning of the beam from a reflector antenna by using a subreflector that is offset from the optical axis of the reflector antenna and revolves about that axis.

b. Description of the Prior Art

Many optical, radio-frequency antennas, such as the cassegrainian antenna depicted in FIG. 1 utilize a feed 11, a main reflector 12 and a subreflector 13 to generate a narrow, pencil-shaped beam aligned with the centerline or optical axis 14 of the antenna. Such antennas are used for many purposes such as communicating with, and for the tracking of, earth satellites. However, in instances where the initial position of the satellite is not well known, the antenna must first search for and find the position of the satellite in order to "lock-on to" or acquire and begin tracking the satellite. Unfortunately, the narrow, pencil-shaped beam that is generated by such an antenna, and that has a fixed position relative to the main reflector, is not a desirable beam shape to use for the purpose of searching for and acquiring a satellite.

If the subreflector 13 that is depicted in FIG. 1 as being located on the centerline 14 of the antenna is modified so as to be offset from the centerline 14 by a small amount and is then caused to revolve about the centerline, this movement of the subreflector will, in turn, cause the center of the antenna pencil beam that is generated by the modified antenna also to be offset slightly from the centerline or optical axis 14 of the antenna and to move or scan along a circular path about the centerline of the antenna. The scanning motion of the beam that is generated by the modified antenna facilitates the search for and acquisition of a satellite.

2. SUMMARY OF THE INVENTION

The present invention provides a single antenna that, in one configuration substantially increases the spatial area scanned by the antenna and thus is adapted to the search and acquisition of a satellite, and in a second configuration is adapted to the tracking and communication with the satellite. The present invention uses the forces generated by the rotation of the subreflector to change the positioning of the subreflector automatically.

The present invention uses an electrical motor to rotate the sub-reflector. The shaft of the motor is aligned with the optical axis of the main reflector. When the motor is not operating, one or more springs hold the subreflector in a position such that it is aligned with the shaft and with the optical axis of the main reflector. When the subreflector is aligned with the optical axis the antenna is used for the tracking of and communication with the satellite.

However, when the motor is turned on and the sub-reflector rotates, the forces generated by the rotation cause the sub-reflector to shift to and remain in a position that is offset from the rotating shaft of the motor, which shift in position, in turn, causes the sub-reflector to be offset from, and to revolve about, the optical axis of the antenna. The consequent scanning of the antenna beam about the central axis of the antenna facilitates the search for, and acquisition of, the satellite. By using the rotational forces, instead of using an electrical solenoid to shift the sub-reflector into the offset position, this invention avoids any need for brushes and a commutator for connecting to a solenoid that would be located on the spinning subreflector and used to shift the position of the subreflector or any need for thrust bearings and shift mechanisms that would be required if the solenoid were located elsewhere. Any such brushes and commutator or thrust bearings and shift mechanisms would complicate the system and likely degrade its reliability.

3. BRIEF DESCRIPTION OF THE DRAWINGS

FIG. 6 depicts the second embodiment in the position that occurs when the mounting mechanism is not being rotated.

4. DETAILED DESCRIPTION

Figure 1:
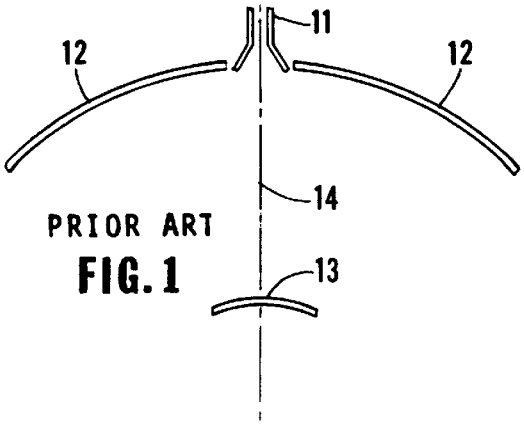
PRIOR ART FIG. 1
FIG. 1 is a schematic depiction of a cassegrainian antenna of the prior art.
Figure 2:
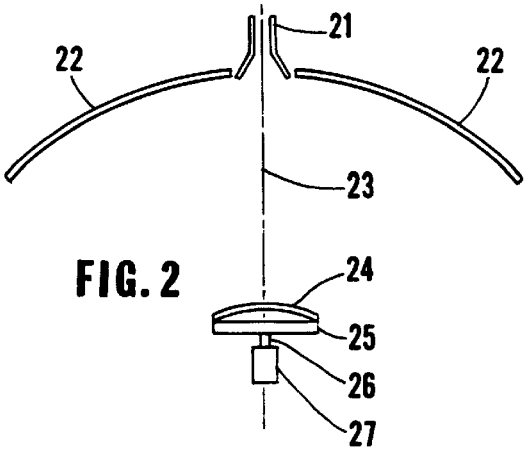
FIG. 2 is a schematic depiction of the basic elements of the invention.

FIG. 2 is a schematic depiction of the preferred embodiment of the invention consisting of an antenna feed 21, a main reflector 22 having an central, optical axis 23, a subreflector 24, and a shiftable mounting mechanism 25 that is mounted on drive shaft 26, which shaft is driven by motor 27. When the motor is not operating, the shiftable mounting mechanism 25, together with one or more springs or other position restoring mechanism within the shiftable mounting mechanism 25 causes the subreflector to be aligned with the central, optical axis 23. When the motor is turned on, it causes shaft 26 and shiftable mounting mechanism 25 and subreflector 24 to rotate. In the preferred embodiment, the mounting mechanism and subreflector rotate at approximately 10 hertz. Shiftable mounting mechanism 25 allows the position of subreflector 24 to shift in response to the forces generated by the rotation such that the axis of subreflector 24 is offset from axis 23 and revolves about axis 23, thus causing the pencil beam that is generated by the antenna to scan in a circular manner about axis 23.

Figure 3:
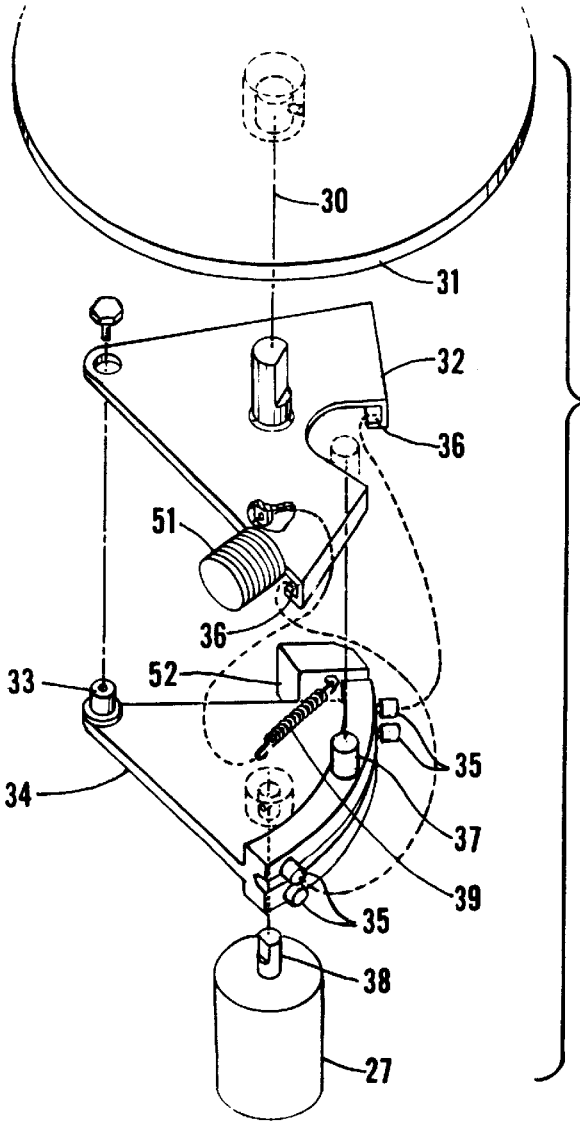
FIG. 3 is an exploded, pictorial view of the shiftable mounting mechanism used in one embodiment of the invention.

FIG. 3 is a pictorial, exploded view of the preferred embodiment of the shiftable mounting mechanism 25. Subreflector 31 having a central axis 30 is attached by a post or other means to pivot plate 32. By means of pivot post 33, pivot plate 32 is pivotably attached to rotating plate 34. Cam followers 35, which travel within channels 36 further support pivot plate 32 and avoid binding forces that might otherwise be generated at pivot post 33. Rotating plate 34, is mounted on shaft 38. When shaft 38 is not rotating, spring 39 causes pivot plate 32 to be held in the position depicted in FIG. 4, such that the axis 41 of subreflector 31 is aligned with shaft 38 and with the central, optical axis of the antenna. Rotation of shaft 38 causes plate 34 and pivot plate 32 and subreflector 31 also to rotate. The rotational forces cause pivot plate 32 to shift to and remain in the position relative to plate 34 that is depicted in FIG. 5.

Figure 4:
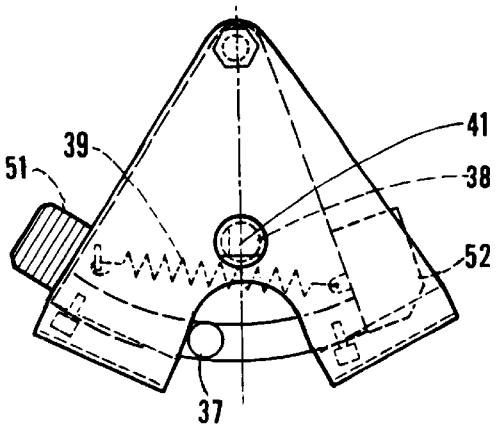
FIG. 4 depicts the mounting mechanism when the pivot plate is the position that occurs when the mounting mechanism is not being rotated.
Figure 5:
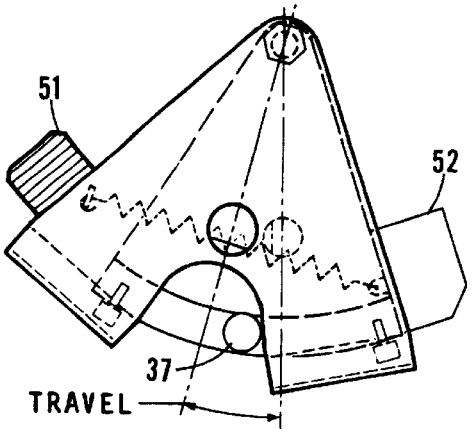
FIG. 5 depicts the shiftable mounting mechanism of the invention when the pivot plate is in the offset position that occurs when the mechanism is being rotated.

As depicted in FIGS. 3, 4 and 5 limit post 37 limits the pivoting of pivot plate 32 relative to rotating plate 34 so that, in the absence of rotation, the axis of subreflector 31 is aligned with the optical axis of the antenna as depicted in FIG. 4 and when rotating, the axis of subreflector 4 is offset from the optical axis of the antenna as depicted in FIG. 5.

The rotational forces that cause pivot plate 32 to shift to and remain in the position depicted in FIG. 5 can be a combination of the inertial forces and centrifugal forces or can be centrifugal forces alone. When the motor is first turned on and plate 34 first begins to rotate, the inertia of pivot plate 32 will tend to cause pivot plate 32 to rotate about pivot post 33. In addition, if the mass of pivot plate 32 is not balanced relative to shaft 26, then this imbalance will generate a centrifugal force that can be used to shift pivot plate 32 into the offset position depicted in FIG. 5. If not otherwise provided, a weight 51 may be added to plate 32 to provide this imbalance. Without regard to the initial balance or imbalance of pivot plate 32 with respect to shaft 26, the mass of pivot plate 32 is distributed such that, in the offset position, the imbalance of the mass with respect to rotation about shaft 26 generates a centrifugal force that causes pivot plate 32 to remain in the offset position.

In the preferred embodiment, when pivot plate 32 is in the offset position depicted in FIG. 5, the center of mass for plate 34 is designed so as to be offset from shaft 26 in the opposite direction and in the same amount as the offset of imbalance of the mass of pivot plate 32 with respect to shaft 26, thus bringing the composite structure of pivot plate 32, plate 34 and subreflector 24 into rotational (dynamic) balance about shaft 26. If such imbalance is not otherwise provided, a counterweight 52 may be added to plate 34 to provide a countering imbalance. Dynamic balance need not be maintained when pivot plate 32 is in the position depicted in FIG. 4, because the plates and the subreflector are not then rotating.

Figure 6:
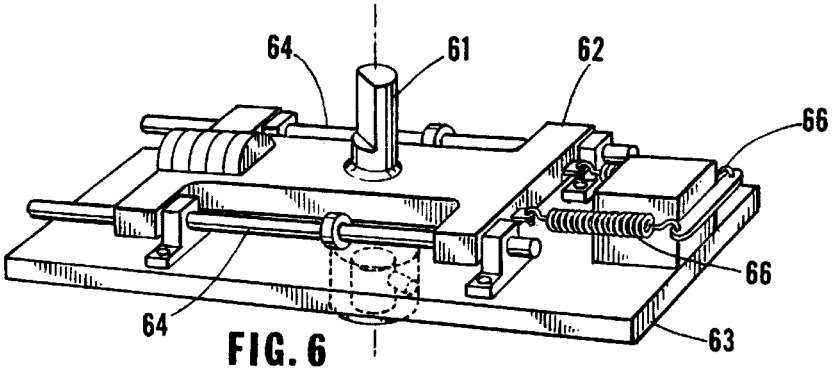
FIG. 6 depicts a second embodiment of the shiftable mounting mechanism in which one plate slides sideways relative to a second plate in order to shift the subreflector to an offset position when the mounting mechanism is being rotated.

FIG. 6 depicts a second embodiment of the shiftable mounting mechanism. The subreflector is centered upon and mounted on post 61, which post is part of sliding plate 62. Sliding plate 62 is attached to plate 63 by means of rails 64. By means of collar 65, plate 63 is mounted on the shaft 26 depicted in FIG. 2. When plate 63 is not rotating, springs 66 hold sliding plate 62 in the position depicted in FIG. 6.

Figure 7:
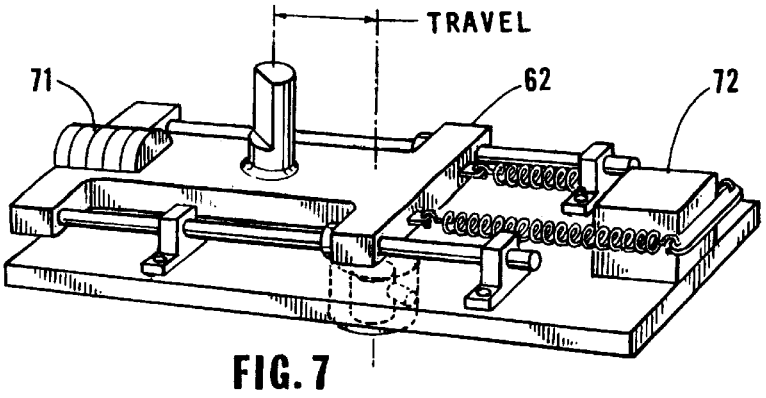
FIG. 7 depicts the second embodiment of the shiftable mounting mechanism in the position that occurs when the mounting mechanism is being rotated.

When plate 63 rotates, rotational forces arising from an imbalance in the mass of plate 63 and the subreflector relative to shaft 26 cause sliding plate 62 to slide to, and remain at, the position depicted in FIG. 7. If such imbalance does not already exist, weight 71 may be added to sliding plate 62 to provide this imbalance. The mass of plate 63 is arranged relative to shaft 26 such that, when sliding plate 62 is in the position depicted in FIG. 7, i.e. when rotating, the imbalance of plate 63 relative to shaft 26 offsets the imbalance of sliding plate 62 and the subreflector. If such counterbalancing mass in plate 63 does not already exist, it may be obtained by adding counterweight 72.

Although in the embodiments described above the rotor of the motor is aligned with the central axis of the antenna, it should be understood that the motor need not be aligned with this axis. Only the drive shaft that causes the rotation of the subreflector need be so aligned. The motor, instead, could be located in a position that is not aligned with the central axis and connected by gears, belts, or other means to the drive shaft.

Although the embodiments described above use one or more springs to hold the subreflector in alignment with the central axis of the antenna when the motor is not operating, it should be understood that pneumatic pressure or some other position restoring mechanism could, instead, be used to restore the position of the subreflector into alignment with the central axis of the antenna when the motor is not operating.

It should be understood that although in this disclosure the subreflector and the plate to which it is attached are described and claimed as if they were separate and distinct items, the two elements may, in fact, constitute but a single physical body that operates as a subreflector and that is attached in a moveable manner to a second plate. It should be further understood that the elements which, for purpose of simplicity, are referred to as plates, may in fact not be bounded by flat surfaces, i.e. not have the form of flat plates, but instead may be bodies having much more generally shaped surfaces.

I claim:

1. A reflector antenna comprising a main reflector having an optical axis, an antenna feed, a shiftable mounting mechanism having a position restoring mechanism, a rotatable shaft having an axis and being driven by a motor, the axis of the shaft being aligned with the optical axis of the main reflector, a subreflector having an axis, the subreflector being attached to the shiftable mounting mechanism, the shiftable mounting mechanism being attached to the shaft and the forces generated by rotation of the shaft causing the shiftable mounting mechanism to shift to and remain in a position such that the subreflector is offset from the shaft so that rotation of the shaft causes the subreflector to revolve about the optical axis of the main reflector and so that, in the absence of the rotational forces, the position restoring mechanism within the shiftable mounting mechanism causes the axis of the subreflector to be aligned with the optical axis of the main reflector.

2. The device of claim 1 wherein the shiftable mounting mechanism comprises a first body-to which the subreflector is attached, and a second body attached to the shaft, the first body being pivotably attached to the second body, the point of said pivot attachment being offset from the axis of the shaft, and including position restoring means.

3. The device set forth in claim 2 in which the position restoring mechanism comprises one or more springs.

4. The device of claim 1 wherein the shiftable mounting mechanism comprises a first body to which the subreflector is attached, and a second body attached to the shaft, the first body being slideably attached to the second body, and including position restoring means.

5. The device set forth in claim 3 in which the position restoring mechanism comprises one or more springs.

6. The device set forth in claim 1, in which the position restoring mechanism comprises one or more springs.

* * * * *